US009327415B1

(12) United States Patent
Hovsepian

(10) Patent No.: US 9,327,415 B1
(45) Date of Patent: May 3, 2016

(54) INTERCHANGEABLE HEAD SIZE PRECISION RAZOR DEVICE

(71) Applicant: Tadhe Hovsepian, Los Angeles, CA (US)

(72) Inventor: Tadhe Hovsepian, Los Angeles, CA (US)

( * ) Notice: Subject to any disclaimer, the term of this patent is extended or adjusted under 35 U.S.C. 154(b) by 174 days.

(21) Appl. No.: 14/152,250

(22) Filed: Jan. 10, 2014

(51) Int. Cl.
*B26B 21/22* (2006.01)
*B26B 21/52* (2006.01)

(52) U.S. Cl.
CPC ..... *B26B 21/521* (2013.01)

(58) Field of Classification Search
CPC .... B26B 21/225; B26B 21/521; B26B 21/522
USPC ..... 30/527, 529, 532
See application file for complete search history.

(56) References Cited

U.S. PATENT DOCUMENTS

| | | | | |
|---|---|---|---|---|
| D254,692 | S | 4/1980 | Del Re | |
| 4,461,078 | A * | 7/1984 | Carreker | B26B 21/40 30/47 |
| 4,700,477 | A | 10/1987 | Heller | |
| 4,926,553 | A | 5/1990 | Miskin et al. | |
| 4,989,328 | A | 2/1991 | Sokoloff | |
| D355,049 | S * | 1/1995 | Yasui | D28/48 |
| 5,526,567 | A * | 6/1996 | Carson, III | B26B 21/522 30/346.58 |
| 6,581,290 | B1 | 6/2003 | Fishel | |
| 7,140,116 | B2 | 11/2006 | Coffin | |
| D542,468 | S | 5/2007 | Stiles | |
| 8,683,701 | B1 * | 4/2014 | Loftin | B26B 21/38 250/455.11 |
| 2010/0263220 | A1 * | 10/2010 | Bruno | B26B 21/225 30/531 |
| 2013/0061481 | A1 * | 3/2013 | Cooney | B26B 21/521 30/526 |
| 2013/0145626 | A1 * | 6/2013 | Xu | B26B 21/446 30/41 |
| 2014/0150264 | A1 * | 6/2014 | Micinilio | B26B 21/522 30/41 |

FOREIGN PATENT DOCUMENTS

| | | | |
|---|---|---|---|
| EP | 1 724 074 | A2 * | 11/2006 |
| EP | 1 724 074 | A3 * | 1/2007 |
| EP | 2 387 489 | B1 * | 5/2014 |
| WO | WO 2014/073500 | A1 * | 5/2014 |

* cited by examiner

*Primary Examiner* — Hwei C Payer

(57) ABSTRACT

An interchangeable head size precision razor device allows for selectively interchanging thin width razor heads to facilitate precise styling. The device includes a handle having a top end and a bottom end. The handle is elongated between the top end and the bottom end. A connector is coupled to and extends from the handle proximate the top end of the handle. A plurality of razor heads is provided. Each razor head has a unique length extending between opposite lateral sides of the razor head. Each razor head has a respective socket. The connector is couplable to the socket of each razor head wherein the razor heads are interchangeably couplable to the connector.

11 Claims, 4 Drawing Sheets

INTERCHANGEABLE HEAD SIZE PRECISION RAZOR DEVICE

BACKGROUND OF THE DISCLOSURE

Field of the Disclosure

The disclosure relates to razor devices and more particularly pertains to a new razor device for selectively interchanging thin width razor heads to facilitate precise styling.

SUMMARY OF THE DISCLOSURE

An embodiment of the disclosure meets the needs presented above by generally comprising a handle having a top end and a bottom end. The handle is elongated between the top end and the bottom end. A connector is coupled to and extends from the handle proximate the top end of the handle. A plurality of razor heads is provided. Each razor head has a unique length extending between opposite lateral sides of the razor head. Each razor head has a respective socket. The connector is couplable to the socket of each razor head wherein the razor heads are interchangeably couplable to the connector.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
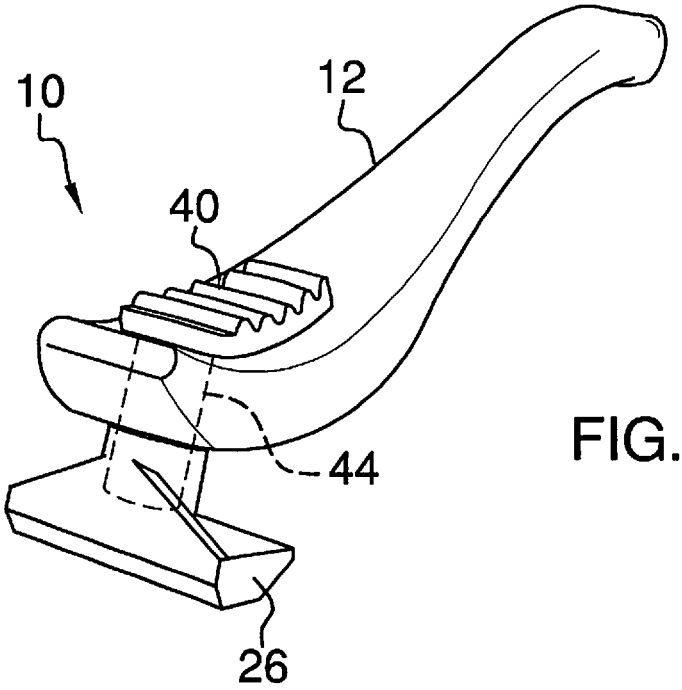
FIG. 1 is a top back side view of an interchangeable head size precision razor device according to an embodiment of the disclosure.
Figure 2:
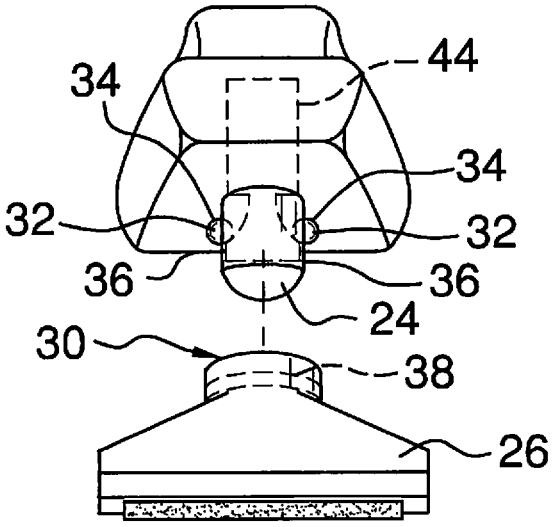
FIG. 2 is a partially exploded top view of an embodiment of the disclosure.
Figure 3:
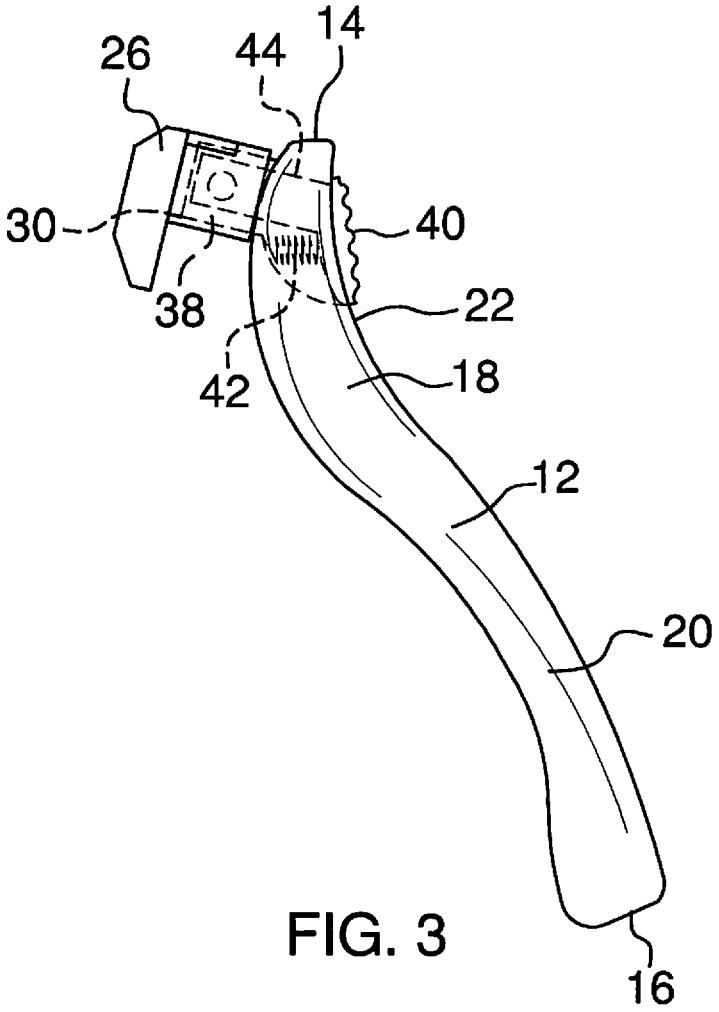
FIG. 3 is a side view of an embodiment of the disclosure.

With reference now to the drawings, and in particular to FIGS. 1 through 6 thereof, a new razor device embodying the principles and concepts of an embodiment of the disclosure and generally designated by the reference numeral 10 will be described.

As best illustrated in FIGS. 1 through 6, the interchangeable head size precision razor device 10 generally comprises a handle 12 having a top end 14 and a bottom end 16. The handle 12 is elongated between the top end 14 and the bottom end 16. The handle 12 has an upper section 18 and a lower section 20. Each of the upper section 18 and the lower section

20 may be arcuate and may curve in opposite directions relative to each other. The upper section 18 is curved such that a rear face 22 of the upper section 18 is concave.

Figure 4:
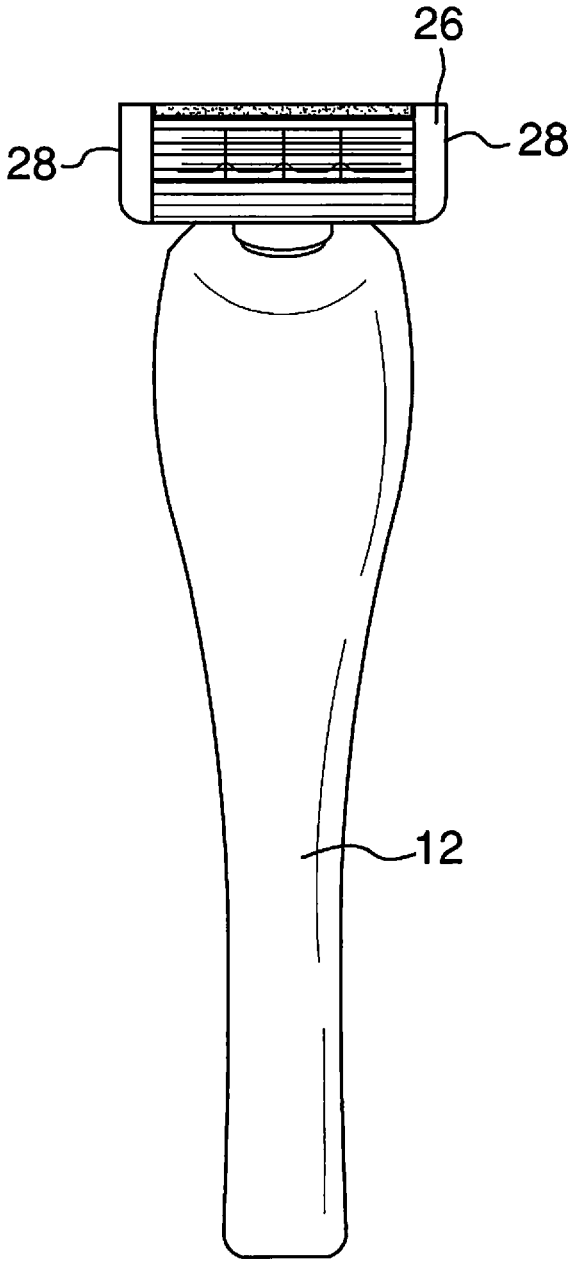
FIG. 4 is a front view of an embodiment of the disclosure.
Figure 5:
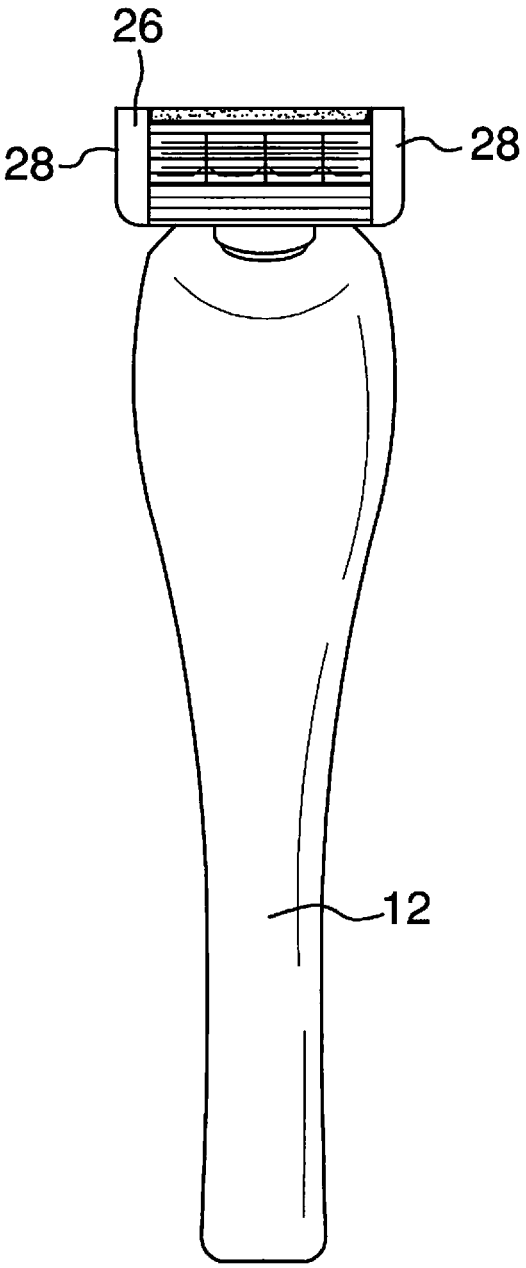
FIG. 5 is a front view of an embodiment of the disclosure.
Figure 6:
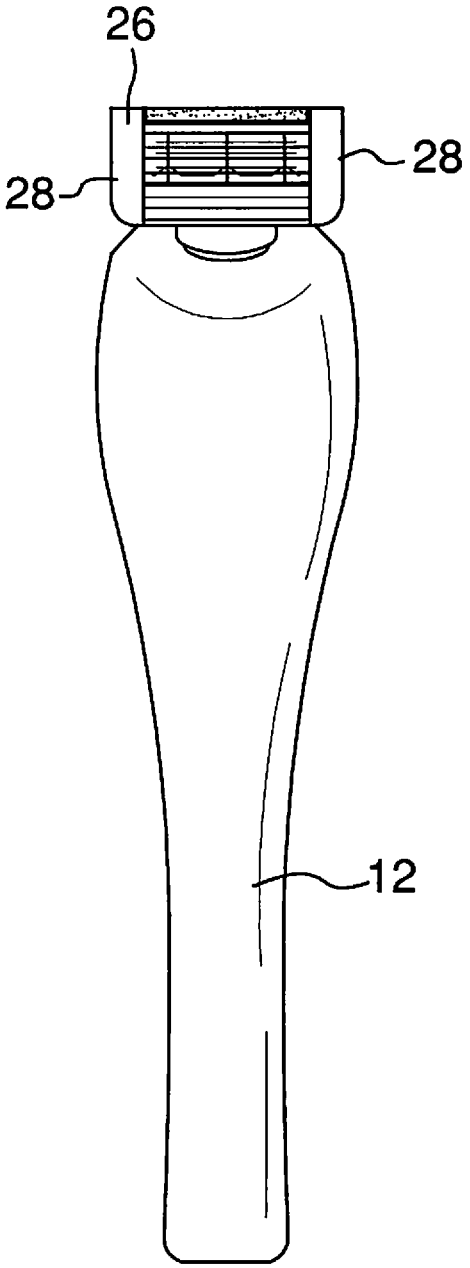
FIG. 6 is a front view of an embodiment of the disclosure.

A connector 24 is coupled to and extends from the handle 12 proximate the top end 14 of the handle 12. A plurality of razor heads 26 is provided. The razor heads 26 are generally conventional and each includes a plurality of blades attached thereto. However, each razor head 26 has a unique length extending between opposite lateral sides 28 of the razor head 26. Each razor head 26 has a respective socket 30. The connector 24 is couplable to the socket 30 of each razor head 26 wherein the razor heads 26 are interchangeably couplable to the connector 24. One of the razor heads 26 has a width between 4.5 millimeters and 5.5 millimeters and is shown in FIG. 6. One of the razor heads 26 has a width between 9.5 millimeters and 10.5 millimeters and is shown in FIG. 5. One of the razor heads 26 has a width between 14.5 millimeters and 15.5 millimeters and is shown in FIG. 4.

A pair of extensions 32 is coupled to and extends from the connector 24. The extensions 32 engage each razor head 26 when each razor head 26 is coupled to the connector 24. Each of the extensions 32 is retractable into the connector 24 such that the extensions 32 disengage from the razor head 26 coupled to the connector 24 wherein the razor head 26 is removable from the connector 24. Each of the extensions 32 has a hemi-spherical outer surface 34 extending from the connector 24. The extensions 32 are positioned on opposite sides 36 of the connector 24. Each socket 30 has a respective channel 38 extending into and around an interior perimeter of the socket 30. Each of the extensions 32 is positioned in the channel 38 of the socket 30 when the razor head 26 is coupled to the connector 24 wherein each razor head 26 is rotatable relative to the connector 24 when the razor head 26 is coupled to the connector 24. A button 40 is coupled to the handle 12 proximate the top end 14 of the handle 12. The button 40 extends into the handle 12 and engages the extensions 32 such that depression of the button 40 permits retraction of the extensions 32 into the connector 24. In particular, the button 40 has a projection 44 positioned adjacent to the extensions 32. A biasing member 42 is positioned in the handle proximate the button 40 and biases the button 40 outwardly of the handle 12 in a direction toward the rear face 22 of the upper section 18 of the handle 12.

In use, as stated above and shown in the Figures, a selectable one of the razor heads 26 is attached to the connector 24. A person then shaves in a conventional manner using the device 10. However, the relatively small size of the razor heads 26 permits more precise styling than can be accomplished with a conventional razor-type device. For example, the device 10 enables shaving of designs into a user's facial hair and/or body hair. The button 40 is depressed to detach the razor head 26 from the handle 12. This allows the user to attach another one of the razor heads 26 to the handle 12 when desired.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

I claim:

1. An interchangeable head size precision razor device comprising:

a handle having a top end and a bottom end, said handle being elongated between said top end and said bottom end;

a connector coupled to and extending from said handle proximate said top end of said handle; and a plurality of razor heads, each razor head having a unique length extending between opposite lateral sides of said razor head, each razor head having a respective socket, said connector being couplable to said socket of each said razor head wherein said razor heads are interchangeably couplable to said connector;

a pair of extensions coupled to and extending from said connector, said extensions engaging each said razor head when each said razor head is coupled to said connector, each of said extensions being retractable into said connector such that said extensions disengage from said razor head coupled to said connector wherein said razor head is removable from said connector.

2. The device of claim 1, further comprising each socket having a respective channel extending into and around an interior perimeter of said socket, each of said extensions being positioned in said channel of said socket when said razor head is coupled to said connector wherein each said razor head is rotatable relative to said connector when said razor head is coupled to said connector.

3. The device of claim 1, further comprising a button coupled to said handle proximate said top end of said handle, said button extending into said handle and engaging said extensions such that depression of said button permits retraction of said extensions into said connector.

4. The device of claim 1, further comprising each of said extensions having a hemi-spherical outer surface extending from said connector.

5. The device of claim 1, further comprising said extensions being positioned on opposite sides of said connector.

6. The device of claim 1, further comprising said handle having an upper section and a lower section, each of said upper section and said lower section being arcuate, said upper section and said lower section curving in opposite directions.

7. The device of claim 6, further comprising said upper section being curved such that a rear face of said upper section is concave.

8. The device of claim 1, further comprising one of said razor heads having a width between 4.5 millimeters and 5.5 millimeters.

9. The device of claim 1, further comprising one of said razor heads having a width between 9.5 millimeters and 10.5 millimeters.

10. The device of claim 1, further comprising one of said razor heads having a width between 14.5 millimeters and 15.5 millimeters.

11. An interchangeable head size precision razor device comprising:

a handle having a top end and a bottom end, said handle being elongated between said top end and said bottom end, said handle having an upper section and a lower section, each of said upper section and said lower section being arcuate, said upper section and said lower section curving in opposite directions, said upper section being curved such that a rear face of said upper section is concave;

a connector coupled to and extending from said handle proximate said top end of said handle;

a plurality of razor heads, each razor head having a unique length extending between opposite lateral sides of said razor head, each razor head having a respective socket, said connector being couplable to said socket of each said razor head wherein said razor heads are interchangeably couplable to said connector, one of said razor heads having a width between 4.5 millimeters and 5.5 millimeters, one of said razor heads having a width between 9.5 millimeters and 10.5 millimeters, one of said razor heads having a width between 14.5 millimeters and 15.5 millimeters;

a pair of extensions coupled to and extending from said connector, said extensions engaging each said razor head when each said razor head is coupled to said connector, each of said extensions being retractable into said connector such that said extensions disengage from said razor head coupled to said connector wherein said razor head is removable from said connector, each of said extensions having a hemi-spherical outer surface extending from said connector, said extensions being positioned on opposite sides of said connector;

each socket having a respective channel extending into and around an interior perimeter of said socket, each of said extensions being positioned in said channel of said socket when said razor head is coupled to said connector wherein each said razor head is rotatable relative to said connector when said razor head is coupled to said connector; and a button coupled to said handle proximate said top end of said handle, said button extending into said handle and engaging said extensions such that depression of said button permits retraction of said extensions into said connector.

* * * * *